US007530155B1

(12) United States Patent
Nikkel

(10) Patent No.: US 7,530,155 B1
(45) Date of Patent: May 12, 2009

(54) CLOSE EDGE DISTANCE PULLING HEAD

(76) Inventor: Robert E. Nikkel, 4101 Mount Vernon Ct., Fort Collins, CO (US) 80525

( * ) Notice: Subject to any disclaimer, the term of this patent is extended or adjusted under 35 U.S.C. 154(b) by 0 days.

(21) Appl. No.: 12/033,544

(22) Filed: Feb. 19, 2008

(51) Int. Cl.
*B21J 15/10* (2006.01)
*B21B 31/00* (2006.01)

(52) U.S. Cl. ..... 29/524.1; 72/391.6; 29/243.521

(58) Field of Classification Search .....
29/243.521–243.527, 524.1; 72/391.6
See application file for complete search history.

(56) References Cited

U.S. PATENT DOCUMENTS 3,017,052 A * 1/1962 Kolec ..... 29/243.521
3,107,806 A * 10/1963 Van Hecke et al. ..... 29/243.522
3,406,557 A * 10/1968 Harris ..... 29/243.521
3,446,509 A * 5/1969 Colosimo ..... 279/7
3,605,478 A 9/1971 Chirco
4,347,728 A * 9/1982 Smith ..... 29/243.529
5,036,572 A * 8/1991 Rosier ..... 29/243.522
5,295,290 A * 3/1994 Johnston ..... 29/243.527
6,032,510 A * 3/2000 Smith et al. ..... 72/391.4

* cited by examiner

*Primary Examiner*—David B Jones
(74) *Attorney, Agent, or Firm*—Marian J. Furst

(57) ABSTRACT

A pulling head for use during installation of blind rivets, blind bolts, and lock bolts. The pulling head includes a faceted jaw holder disposed about a jaw assembly. The tool also includes an anvil sleeve that is rotatable about the jaw holder and jaw assembly and has at least one side opening sized to expose at least one of the facets of the jaw holder. The opening provides a smaller radial distance between the center of the pulling head and its outside edge to allow installation of blind rivets, blind bolts, and lock bolts where there is insufficient space for a full-diameter pulling head.

23 Claims, 7 Drawing Sheets

CLOSE EDGE DISTANCE PULLING HEAD

FIELD OF THE INVENTION

The present invention relates generally to a pulling head for use during installation of blind rivets, blind bolts, and lock bolts, and more particularly to a pulling head that provides a decreased distance between its center and its outside edge to allow installation of blind rivets and lock bolts where there is little space for a pulling head.

BACKGROUND OF THE INVENTION

Blind rivets and lock bolts, also known as pin and collar fasteners, are common industrial fasteners used in the aerospace and other industries. U.S. Pat. No. 4,347,728, entitled "Apparatus and System for Setting Fasteners," issued on Sep. 7, 1982, to Walter J. Smith, describes a pulling head for these types of fasteners which is widely used at present in conjunction with commercially available pulling tools. The Smith pulling head includes a unitized gripping jaw assembly that grips and pulls the pin portion of a fastener, a collet that surrounds the jaw and presses the jaws about the pin, and a swaging portion or anvil assembly disposed about the collet that pushes and swages a collar onto the pin and against a workpiece to secure the fastener in place. The collet and the swaging portion are independently and reciprocally slidable lengthwise relative to each other. The Smith pulling head can apply tensile and compressive forces as great as several thousand pounds.

Many situations arise where a fastener must be installed in a workpiece where the space is inadequate to accommodate the pulling head. In particular, these situations may arise during maintenance or repair of aircraft or other industrial objects. The original fastener may have been installed prior to assembly of nearby components, allowing use of a standard pulling head. However, complete disassembly for repair or maintenance may be inconvenient, impossible, time-consuming, and/or costly.

One possible solution would be to decrease the wall thickness of the cylindrical anvil sleeve and/or the cylindrical collet to provide a smaller outer diameter for the anvil sleeve. However, this is undesirable, because decreasing the overall wall thickness of the sleeve or the collet would also decrease its strength, making it prone to failure under the forces to which it is subjected during fastener installation.

Thus, there is a need for a pulling head for installing blind rivets, blind bolts, and lock bolts that allows installation of the fasteners in tight areas close to obstructions extending outward from a workpiece without compromising the compressive and tensile strength of the pulling head.

SUMMARY OF THE INVENTION

To achieve the foregoing and other objects and in accordance with the purpose of the present invention broadly described herein, one embodiment of this invention comprises a pulling head for installing fasteners that are selected from blind rivets, blind bolts, and lock bolts. The pulling head comprises jaws symmetrically disposed about a longitudinal axis and adapted for gripping the fastener, a jaw holder positioned about the jaws along the axis, and an anvil sleeve positioned about the jaw holder. The jaw holder has proximal means for joining the jaw holder to a spindle of a pulling tool and distal means for pressing the jaws against a fastener shaft. The jaw holder also has an external surface oriented lengthwise in a direction substantially parallel to the longitudinal axis. The anvil sleeve is reciprocally slideable longitudinally relative to the jaw holder and reciprocally rotatable about the axis. The anvil sleeve includes a proximal end adapted to mate with a pulling tool, a distal end adapted to swage fastener collars about fastener shafts, and a side opening sized such that the minimum edge distance of the pulling head is substantially equal to an edge distance of the jaw holder.

The external surface of the jaw holder may comprise at least one facet oriented lengthwise in a direction substantially parallel to the longitudinal axis, with the side opening in the anvil sleeve sized such that the minimum edge distance of the pulling head is substantially equal to an edge distance of the jaw holder at the facet. The anvil sleeve may be reciprocally rotatable about the jaw holder; with the side opening of the anvil sleeve positionable adjacent one of the facets of the jaw holder such that the minimum edge distance of the anvil sleeve is substantially equal to the edge distance of the facet. The pulling head may be operative to apply compressive and tensile forces up to about 10,000 pounds per square inch.

The external surface of the jaw holder may have a plurality of facets, with the anvil sleeve positionable with the side opening exposing substantially all of any one of the facets. The external surface of the jaw holder may comprise six facets forming a hexagonal cross section. The facets and the side opening may have substantially equal lengths in a direction parallel to the longitudinal axis of the pulling head. Alternatively, the external surface of the jaw holder may comprise four facets forming a square cross section in a direction substantially perpendicular to the axis, with the opening in the anvil sleeve sized to expose two adjacent facets of the jaw holder and the anvil sleeve and the jaw holder both reciprocally rotatable about the jaws. The anvil sleeve and the jaw holder may be aligned with each other and rotatable as a unit about the jaws. Also alternatively, the external surface of the jaw holder may comprise eight facets forming an octagonal cross section in a direction substantially perpendicular to the axis; and the anvil sleeve may comprise two side windows positionable to expose two facets of the jaw holder, with the two facets oriented at right angles relative to each other.

Another embodiment of the present invention comprises a pulling tool for installing fasteners that are selected from blind rivets, blind bolts, and lock bolts. The tool comprises a pulling head, a jaw holder positioned about the jaws along the axis, and an anvil sleeve positioned about the jaw holder. The pulling head comprises jaws disposed about a longitudinal axis and adapted for gripping the fasteners. The jaw holder has proximal means for joining the jaw holder to a spindle of a pulling tool, distal means for pressing the jaws about the fastener, and an external surface oriented parallel to a longitudinal axis of the pulling head. The anvil sleeve is reciprocally slideable longitudinally relative to the jaw holder and reciprocally rotatable about the axis. The anvil sleeve includes a proximal end adapted to mate with a pulling tool, a distal end adapted to swage fastener collars about fastener shafts, and a side opening having side edges and sized such that the minimum edge distance of the pulling head is substantially equal to an edge distance of the jaw holder.

In the pulling tool, the external surface of the jaw holder may comprise at least one facet oriented lengthwise in a direction substantially parallel to the longitudinal axis, with each facet having a facet edge distance. In addition, the side opening in the anvil sleeve may be sized such that when the opening is positioned over one of the facets, the minimum edge distance of the pulling head is substantially equal to the edge distance of the facet. The means for joining the jaw holder may be a spindle or a spindle extension that is mateable with a proximal end of the jaw holder. The means for joining the anvil sleeve may comprise a proximal end of the anvil sleeve that is mateable with a pushing mechanism of the tool. The tool may be operative to apply tensile and compressive forces up to about 10,000 pounds per square inch to a fastener. The anvil sleeve may be reciprocally rotatable about the jaw holder. The anvil sleeve and the jaw holder may be reciprocally rotatable about the jaws. The side opening of the anvil sleeve may be positionable to expose two of the facets of the jaw holder such that the minimum edge distance of the anvil sleeve is substantially equal to the edge distances of the facets. The external surface of the jaw holder may comprise eight facets forming an octagonal cross section in a direction substantially perpendicular to the axis, with the anvil sleeve including two side windows positionable to expose two facets of the jaw holder. In this case, the two facets are oriented at right angles relative to each other, and the anvil sleeve and the jaw holder are both reciprocally rotatable about the jaws.

Yet another embodiment of the present invention comprises a jaw holder for a pulling head for installing fasteners that are selected from blind rivets, blind bolts, and lock bolts. The jaw holder comprises a faceted external surface; a substantially cylindrical internal surface having a longitudinal axis at its radial center; means for joining the jaw holder to a spindle of a pulling tool; and means for forcing jaws positioned inside the jaw holder into gripping engagement with a fastener shaft. The jaw holder may have an exterior surface having a plurality of facets. The exterior surface may include an alignment key extending outward from the surface and mateable with an alignment keyway of an anvil sleeve positioned about the jaw holder. The jaw holder may have strength sufficient to withstand application of tensile forces up to about 10,000 pounds per square inch in a direction parallel to the axis.

Still another embodiment of the present invention comprises an anvil sleeve. The anvil sleeve comprises a proximal end adapted to mate with a pulling tool; a distal end adapted to swage fastener collars about fastener shafts; and a partially cylindrical tubular wall including at least one side opening. The wall may include a plurality of side openings. Alternatively, the opening in the wall may be sized to expose a plurality of facets in a jaw holder positioned inside the anvil sleeve. The wall may have an internal surface, with the internal surface including an alignment keyway mateable with an alignment key of a jaw holder positioned inside the anvil sleeve. The anvil sleeve may have strength sufficient to withstand compressive forces up to about 10,000 pounds per square inch in a direction parallel to a longitudinal axis of the partially cylindrical wall.

BRIEF DESCRIPTION OF THE DRAWINGS

These and other features, aspects, and advantages of the present invention will become better understood with reference to the following description, appended claims, and accompanying drawings, where:

DESCRIPTION

The present invention comprises an improvement to the pulling head described in U.S. Pat. No. 4,347,728, entitled "Apparatus and System for Setting Fasteners," issued on Sep. 7, 1982, to Walter J. Smith, which is incorporated herein by reference in its entirety. In the following discussion, the term "proximal" is used to describe a position closer to the pulling tool or gun, and the term "distal" is used to describe a position farther away from the pulling tool or gun. "Edge distance" refers to the radial distance from the longitudinal axis of the pulling head to an exposed surface of the pulling head.

Figure 1:
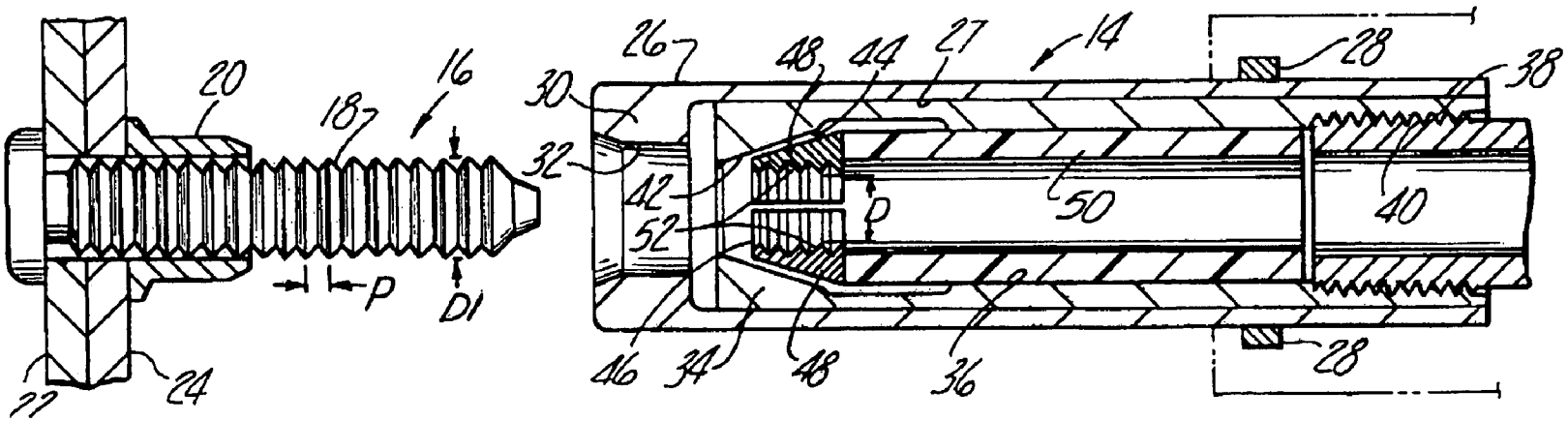
FIG. 1 (prior art)
FIG. 1 is a partial longitudinal cross sectional view of a prior art pulling head and fastener.

FIG. 1 is a partial longitudinal cross section of the Smith pulling head. Nose assembly 14 is mounted to a pulling gun 12 and can be used to install fastener 16 to join workpieces 22 and 24 by swaging collar 20 onto the ridged shaft of pin 18. The nose assembly 14 comprises a generally tubular outer anvil member 26 having a cylindrical axial bore 27 and having radially extending ears or lugs 28 near its proximal end for locking engagement with the receiving end of the casing of the gun member 12. The opposite end of the outer anvil member 26 is substantially closed by an anvil portion 30 having a swaging bore 32 located therein. The swaging bore 32 can have a variety of shapes selected to facilitate swaging. Generally tubular collet member 34 is slidably disposed within the outer anvil member 26. Collet member 34 has a generally cylindrical outer surface and an axial bore 36 which is internally threaded at its rearward portion 38. This rearward portion 38 is threadably engaged with a threaded portion 40 of a piston rod (partially shown) of the pull gun member 12. The forward end of the collet member 34 has an axial, radially inwardly tapered bore 42 which terminates at its enlarged end in an increased diameter bore portion 44.

A unitized jaw assembly and follower 46 is slidably disposed within the collet member 34 and comprises a plurality of jaw members 48 secured at their rearward ends to the leading surface of a generally tubular elastomeric sleeve member 50. The outer surfaces of the jaw members 48 define a frusto conically inclined surface which is matable within the tapered bore 42.

In one form of the invention the elastomeric member 50 can be of a flexible urethane construction. The jaw members 48 (which in one form are three in number) can be bonded to the sleeve member 50 as a separate step or can be bonded simultaneously with the forming of the elastomeric member 50 where a urethane construction is used. The rearward ends of the jaw members 48 can be notched, grooved or serrated to increase the surface area and to thereby enhance the bond with the sleeve member 50. Thus the jaw members 48 are flexibly secured to the resilient sleeve member 50 and as secured can resiliently move radially. Note that since the member 50 is elastomeric, the jaw members 48 can, to a degree, move resiliently axially.

The jaw members 48 have pluralities of teeth 52 for gripping the grooves of the pin member 18. Note that the teeth 52 are of a shape which is similar to and generally complement the grooves of pin member 18. As secured to the sleeve member 50 the teeth 52 of each of the jaw members 48 are located and held in axial alignment with those of the other jaw members 48. Since relative axial movement between jaw members 48 is inhibited by the sleeve member 50, axial misalignment between teeth 52 is substantially precluded whereby proper engagement of the grooves of the pin 18 by the teeth 52 of all of the jaw members 48 is substantially assured.

It is desirable that the jaw members 48 not be held closed under a high preload. To this end, with the present invention, the jaw members 48 can be located via the flexible connection with the sleeve member 50 such that in their relaxed, non actuated condition the jaw members are generally opened, i.e. radially spaced from each other, whereby the crests of the jaw teeth 52 define an insertion diameter D. The diameter D is slightly less than the crest diameter D1 on the pin member 18 whereby a preselected minimum interference is provided. The magnitude of this interference is selected to provide a minimum insertion force when the pull gun 12 is applied to the pin 18 and at the same time to assure sufficient interference during initial gripping. The initial gripping of the pin member 18 occurs when the pull gun assembly 10 is actuated to move the collet member 34 rearwardly relatively to the outer anvil 26 at which time the tapered bore 42 engages the frusto conical surface of the jaw members 48. The initial gripping or interference must be sufficient to hold the jaw and follower assembly 46 to the grooves of the pin 18 so that the jaws 48 will not slip off the pin 18. Further relative rearward movement of the collet member 34 will cause the jaw members 48 to move forwardly (relatively) into the tapered bore 42 causing the jaw members 48 to attain their fully closed position whereby gripping of the pin 18 is complete. Further movement of the collet 34 and the jaw and follower assembly 46 relative to the outer anvil 26 will result in application of the desired relative axial force between pin 18 and collar 20 and in setting of the fastener 16; if the stroke of the pull gun 12 is insufficient to completely set the fastener 16, its continued actuation will result in a second cycle, i.e. reciprocation of collet 34 and jaw and follower assembly 46 whereby the pin member 18 will be gripped closer to the collar 20. Upon setting of the fastener 16, the pin member 18 will be severed at one of the grooves near the end of the collar 20. The severed portion of the pin member 18 will pass through the pull gun 12 via sleeve member 50 for ejection out the rear of the pull gun 12.

One shortcoming of the Smith pulling head is that the distance from the center of the central lengthwise axis of the pulling head radially outward to the exterior surface of the anvil member 26 is often too great for the pulling head to be used in locations where there is an obstruction extending outward from workpiece 24 close to the position where the fastener is to be installed.

The present invention addresses this shortcoming by substituting a new anvil sleeve for Smith's anvil member 26 and a new jaw holder for Smith's collet member 34, without sacrificing the compressive and tensile strengths of the anvil and collet. Thus, the pulling head of the present invention may be used to install the same fastener types and sizes as the Smith pulling head, and it can be adapted to operate on any blind rivet tool, blind bolt tool, or lock bolt tool that is common to industry by forming the spindle extension and anvil sleeve assembly to fit the desired tool. The new anvil sleeve and jaw holder are compatible with other components of the Smith head, including the unitized jaws. A pulling head with the new anvil sleeve and jaw holder in accordance with the present invention operates in substantially the same manner as the Smith pulling head, with the exception of the differences noted below.

Figure 2:
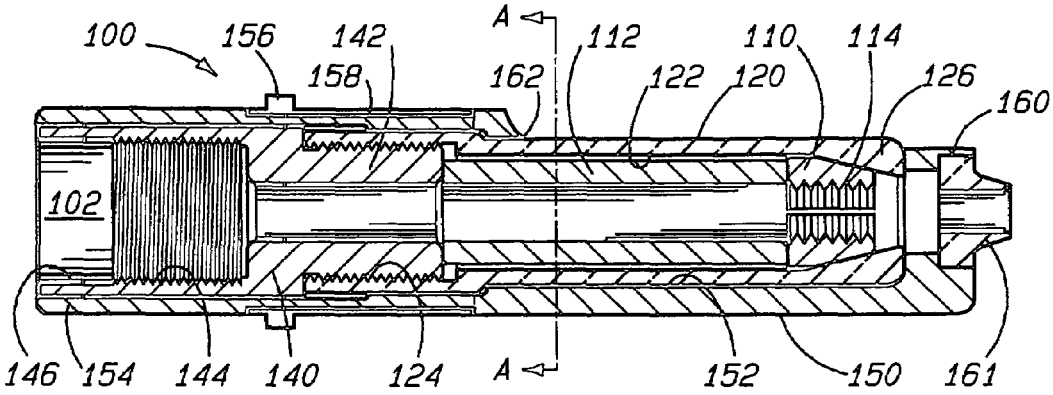
FIG. 2 is a partial longitudinal cross sectional view of a pulling head in accordance with the present invention.

One embodiment of the pulling head, anvil sleeve, and jaw holder of the present invention can be understood with reference to FIGS. 2-6. FIG. 2 is a longitudinal cross sectional view of a pulling head 100. Jaw assembly 110 is substantially the same as jaw assembly 46 of Smith and includes a resilient tube or spring 112 and gripping jaws 114. Jaw holder 120 includes a substantially cylindrical axial bore 122 that retains jaw assembly 110. Jaw holder 120 terminates proximally with an internally threaded portion 124 of the axial bore 122 that is mateable with externally threaded distal portion 142 of spindle extension 140. A portion 144 of the axial bore 146 of spindle extension 140 is internally threaded for engagement with a spindle 102 of an installation tool. The distal end 126 of the axial bore of jaw holder 120 has a frustro conical shape that is operable to force the ends of jaws 114 against a fastener shaft when jaw holder 120 is pulled toward the installation tool. The external surface of jaw holder 120 preferably includes at least one facet. More preferably, jaw holder 120 has at least three facets. Including multiple facets into the outer surface of jaw holder 120 facilitates positioning the pulling head adjacent an obstruction. As shown in FIGS. 2-6, jaw holder 120 has six facets 128*a*-128*f*, forming a hexagonal cross section.

Anvil sleeve 150 has a substantially tubular shape, with a substantially cylindrical interior bore 152, and surrounds jaw holder 120 in the longitudinal dimension. The proximal end 154 of anvil sleeve 150 has a flange 156 and recessed portion 158 to provide for engagement by a pulling tool. Depending on the pulling tool, other engagement means could be used to mount the anvil sleeve onto the tool. The distal end of anvil sleeve 150 may be formed to provide a swaging surface 160, similar to the swaging bore 32 of Smith in FIG. 1, to swage collars onto fastener shafts. Alternatively, surface 160 may be formed to receive an anvil 161 capable of setting other locking devices on fastener shafts. A side opening 162 in anvil sleeve 150 exposes the exterior surface of jaw holder 120. Preferably, opening 162 is sized such that its edges 164 and 166 are alignable with the side edges of one of the facets 128*a-f*, such that the side of the pulling head 100 does not extend radially farther than the facets 128*a-f*. I.e., the edges of anvil sleeve 150 are alignable with any one of the facets 128*a-f* of the jaw holder 120.

Figure 4:
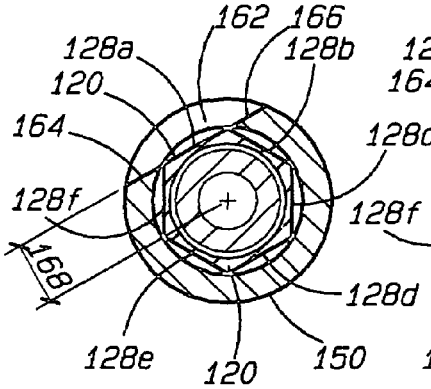
FIG. 4 is an axial cross sectional of the pulling head of FIG. 2 along plane A-A.
Figure 5:
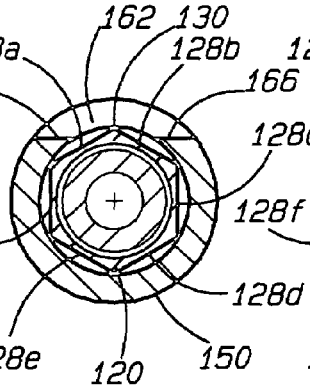
FIG. 5 is another axial cross sectional view of the pulling head of FIG. 2.
Figure 6:
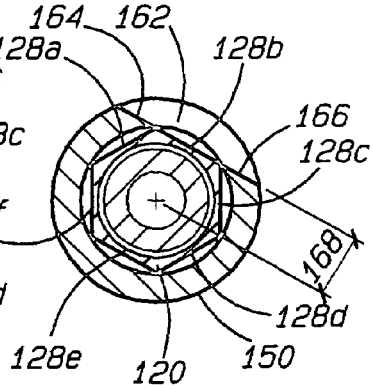
FIG. 6 is yet another axial cross sectional view of the pulling head of FIG. 2.

Anvil sleeve 150 is freely rotatable about jaw holder 120 and the longitudinal axis of the pulling head. As shown in FIG. 4, anvil sleeve 150 is positioned such that edges 164 and 166 align with the surface of facet 128*a*, providing an edge distance 168 for the pulling head that is the same as the edge distance of facet 128*a*. In FIG. 5, anvil sleeve 150 has been rotated 30 degrees clockwise. Facet joint 130 between facets 128*a* and 128*b* is centered in opening 162 and extends farther radially from the center of the pulling head than anvil sleeve edges 164 and 166, providing an increased edge distance 168 equal to the distance from the longitudinal axis to the facet joint 130 between facets 128*a* and 128*b*. In FIG. 6, anvil sleeve 150 has again been rotated clockwise about 30 degrees, and anvil sleeve edges 164 and 166 are aligned with the surface of facet 128*b*. The edge distance is equal to the edge distance 168 shown in FIG. 4.

The edge distance of jaw holder 120 is variable, ranging from the radial distance between the central axis of the pulling head 100 and the center of any of facets 128*a-f* to the radial distance between the central axis and the joint 130 between any two facets. The facet joints 130 function as structural columns or pillars and provide tensile strength to jaw holder 120 that is comparable to the tensile strength that would be obtained with a uniform tube having cylindrical inner and outer surfaces spaced apart the same distance as the facet joint mean thickness.

The edge distance of anvil sleeve 150 ranges between the edge distance of any facet of the jaw holder 120 and the outer diameter of the cylindrical portion of anvil sleeve 150. The inner diameter of anvil sleeve 150 must be sufficient to allow the anvil sleeve to be rotated easily around jaw holder 120, and the outer diameter may be selected to provide the desired compressive strength to the anvil sleeve. However, opening 162 allows the anvil sleeve 150 be positioned such that the pulling head edge distance is equal to the edge distance of the jaw holder facet, which is significantly less than the edge distance of the anvil sleeve 150 away from the opening 162.

Figure 3:
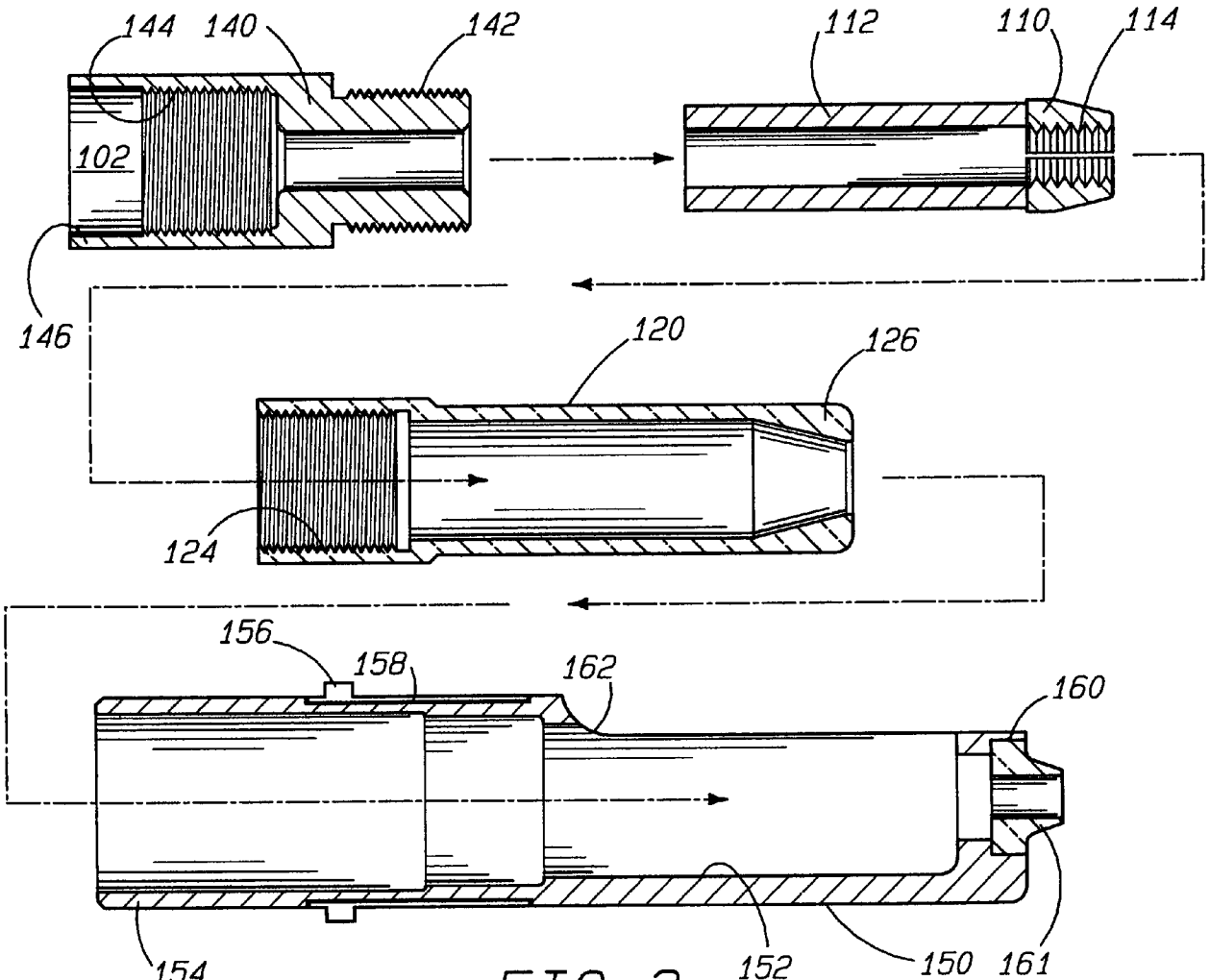
FIG. 3 is an exploded side view of the pulling head of FIG. 2.
Figure 8:
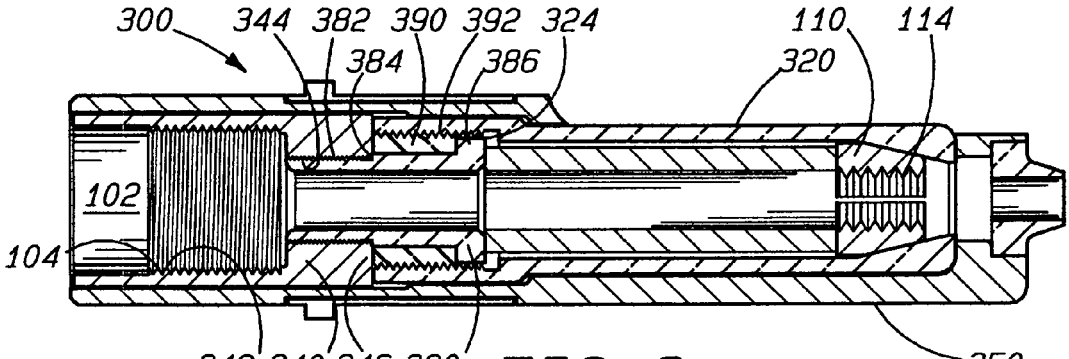
FIG. 8 is a partial longitudinal cross sectional view of another pulling head in accordance with the present invention.
Figure 9:
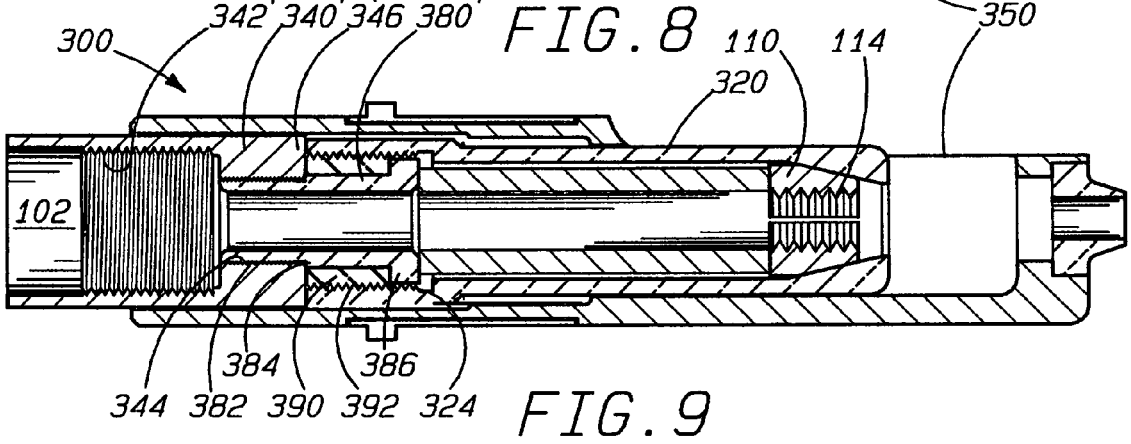
FIG. 9 is a partial longitudinal cross sectional view of the pulling head of FIG. 8 showing the pulling head in an actuated position.

Assembly of the pulling head 100 can be understood with reference to FIG. 3. The proximal end of jaw assembly 110 is positioned ahead of spindle extension 140 with the jaws 114 positioned distally from the spindle extension 140. Then the proximal end of jaw holder 120, including internal threaded portion 124, is placed over the distal end of jaw assembly 110 and screwed onto the threaded end 142 of spindle extension 140. The proximal end of spindle extension 140, including internally threaded portion 144, is screwed onto the externally threaded end of the pulling tool spindle 102. Finally, the proximal end of anvil sleeve 150 is placed around the spindle extension 140 and jaw holder 120, and flange 156 is engaged by a locking nut or other device of the pulling tool.

Figure 7:
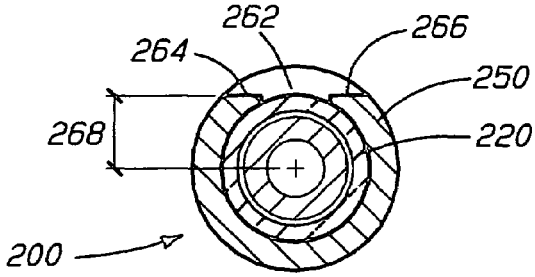
FIG. 7 is an axial cross sectional view of another embodiment of a pulling head in accordance with the present invention.

As shown in FIG. 7, it is possible to decrease the edge distance of a pulling head even if the jaw holder or collet has a cylindrical outer surface. Pulling head 200 has such a cylindrical jaw holder 220. Anvil sleeve 250 partially surrounds jaw holder 220 and includes a longitudinal slot 262. Edges 264 and 266 of slot 262 are spaced apart sufficiently to expose a portion of the cylindrical outer surface of jaw holder 220 and provide an edge distance 268 for the pulling head that is equal to the edge distance of the jaw holder 220.

Referring to FIGS. 8-12, another embodiment 300 of the present invention is useful to install fasteners in locations where the obstruction or obstructions protruding outward from the workpiece surface form(s) a corner, and the distance from the fastener center to the obstruction is limited in both directions. Spindle extension 340 has an internally threaded portion 342 at its proximal end and mateable with pulling tool spindle 102 via external screw threads 104 which mate with internally threaded portion 342 of the spindle extension 340. The spindle extension 340 also has a second internally thread portion 344 at its distal end. Threaded flange 380 has external screw threads 382 that are engageable with the internally threaded portion 344 of the spindle extension 340. Shoulder 384 of threaded flange 380 butts against the distal end 346 of the spindle extension 340. Threaded ring 390 is positioned between shoulder 384 and flange extension 386 of threaded flange 380, with external screw threads 392 that are mateable with internal screw threads 324 of jaw holder 320. The distal portion of jaw holder 320 has an approximately square cross section, with facets 328*a-d* forming right angles with each other at facet joints 330.

Threaded ring 390 has a length in the direction parallel to the longitudinal axis of the pulling head 300 that is slightly less than the spacing between shoulder 384 and flange extension 386. Preferably the difference in the lengths of threaded ring 390 and the shoulder-flange spacing is between about 0.007 and about 0.010 inches. During use, the proximal surface of the flange extension 386 contacts the distal edge of the threaded ring 390 to transfer tensile force to the jaw holder 320.

Figure 11:
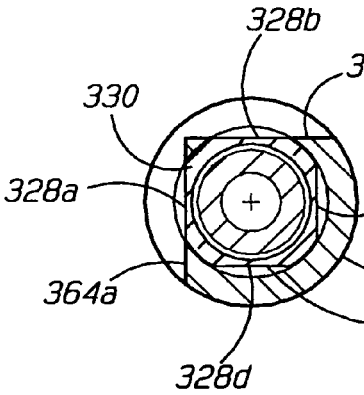
FIG. 11 is an axial cross sectional of the pulling head of FIG. 8.
Figure 12:
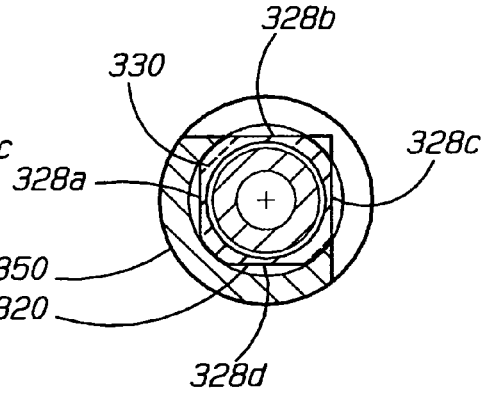
FIG. 12 is another axial cross sectional view of the pulling head of FIG. 8.
Figure 10:
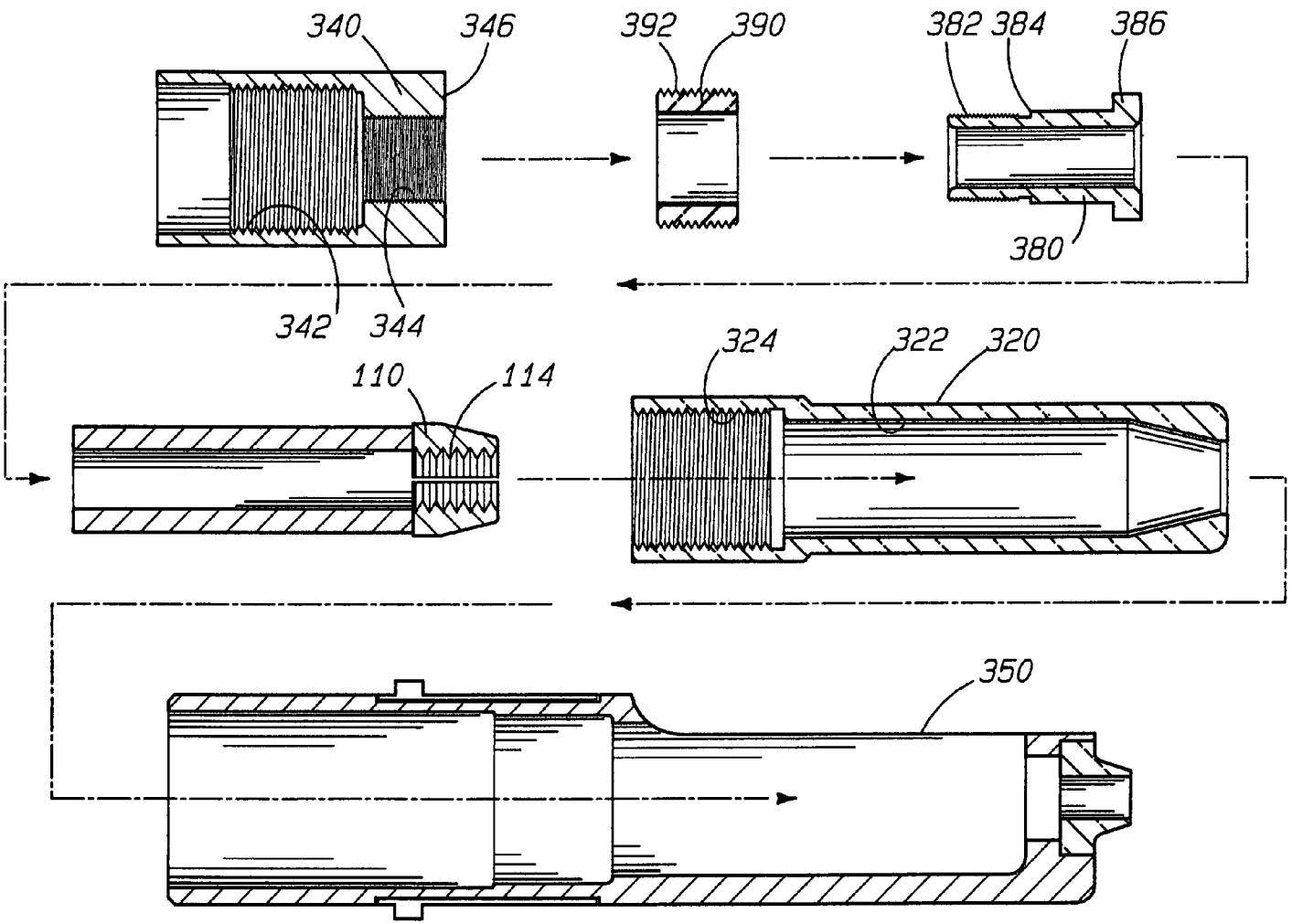
FIG. 10 is an exploded side view of the pulling head of FIG. 8.

Threaded ring 390 also has an inner diameter slightly greater than the outer diameter of the adjacent portion of the threaded flange 380. Thus, threaded ring functions as a bearing for rotation and longitudinal sliding motion of jaw holder 320 about jaw assembly 110 and threaded flange 380, which are fixed to the spindle 102 of the pulling tool via spindle extension 340. Jaw holder 320 and anvil sleeve 350 are easily rotated up to 360 degrees to any position to minimize the edge distances between pulling head 300 and walls or extensions protruding from the workpiece, as shown in FIGS. 11 and 12. Rotating the jaw holder 320 and the anvil sleeve 350 allows the corner pulling head 300 to fit into a corner location. FIG. 11 shows an alignment anvil sleeve 350 to expose facets 328*a* and 328*b* of the jaw holder 320, allowing the pulling head 300 to fit into a corner disposed closely about facets 328*a* and 328*b*. FIG. 12 shows a different alignment of anvil sleeve 350, with facets 328*b* and 328*c* exposed, allowing the pulling head 300 to fit into a different corner disposed about facets 328*b* and 328*c*.

Figure 13:
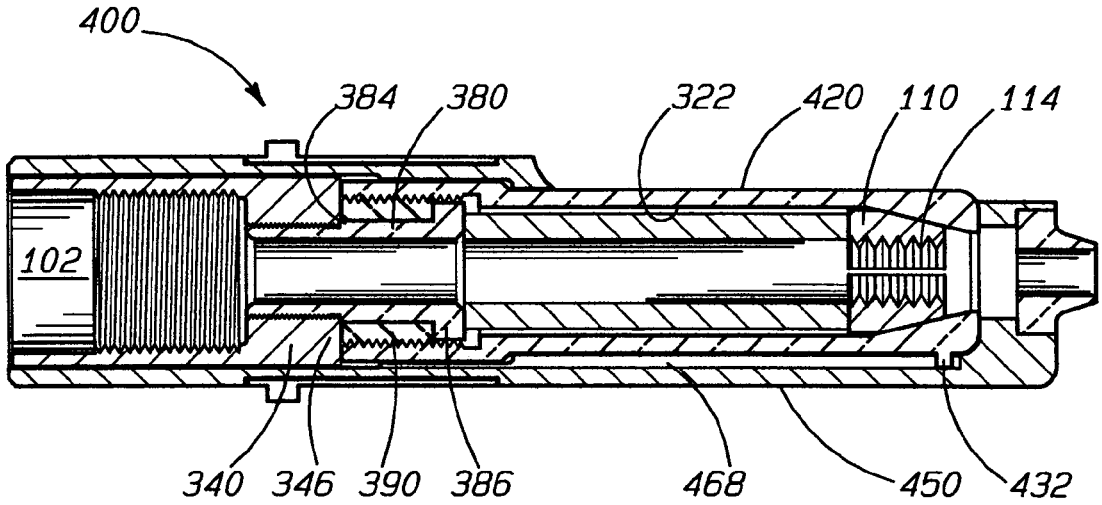
FIG. 13 is a partial longitudinal cross sectional view of yet another pulling head in accordance with the present invention.
Figure 14:
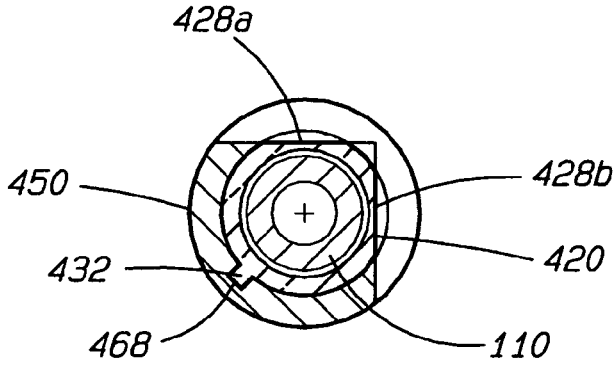
FIG. 14 is an axial cross sectional view of the pulling head of FIG. 13.

Although it is generally not necessary to secure anvil sleeve 350 relative to jaw holder 320 such that the longitudinal edges 364*a* and 364*b* of the anvil sleeve 350 align precisely with the sides of the facets 328*a* and 328*b* of the jaw holder 320, it may be desirable to do so for some applications. As shown in FIGS. 13 and 14, pulling head 400 includes an anvil sleeve 450 with an alignment keyway 468 recessed into its inner wall. Jaw holder 420 includes an alignment key 432 shaped and sized to fit inside alignment keyway 468. All other components and features of pulling head 400 may be identical to those of pulling head 300 and are labeled identically to the features of pulling head 300 in FIGS. 8-11.

The alignment keyway 468 and the alignment key 432 function to maintain a fixed relative orientation of the jaw holder 420 and the anvil sleeve 450 relative to each other, and the jaw holder 420 and anvil sleeve 450 may be positioned simultaneously before pulling head 400 is inserted into a corner to install a fastener adjacent the corner. Alternatively, an alignment key could be integral with anvil sleeve 450 and an alignment keyway could be integral with jaw holder 420.

Pulling head 300 or pulling head 400 can be assembled onto a pulling tool by screwing spindle extension 340 onto the end of spindle 102. Jaw assembly 110 is inserted into jaw holder 320 or 420 with the jaws 114 adjacent the distal end of jaw holder 320 or 420. The proximal end of threaded flange 380 is inserted through the distal end of threaded ring 390 and threaded into the distal internally threaded portion of spindle extension 340 until the proximal shoulder 384 of threaded flange 380 is tight against distal end 346 of spindle extension 340. The proximal end of jaw holder 320 or 420, with jaw assembly 110 inserted within, is then positioned over the flange extension 386 at the distal end of threaded flange 380 and threaded onto the externally threaded portion of threaded ring 390. The correct position of jaw holder 320 or 420 is achieved when the distal end is aligned with the distal end of threaded ring 390. Anvil sleeve 350 or 450 is then slid over jaw holder 320 or 420, with alignment key 432 in alignment keyway 468 (if present) and attached to the pulling tool in the usual manner.

Figure 15:
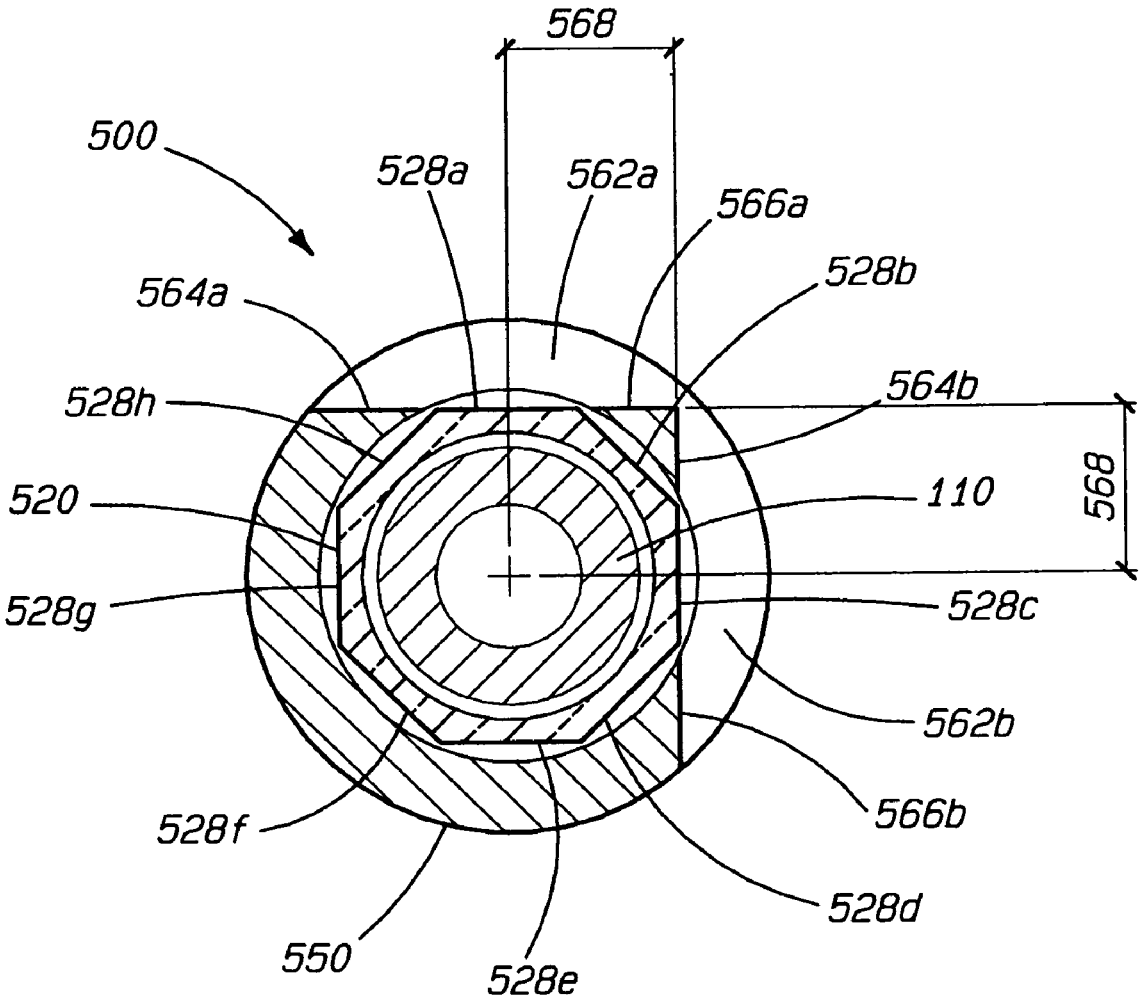
FIG. 15 is an axial cross sectional view of still another embodiment of a pulling head in accordance with the present invention.

Another pulling head 500 in accordance with the present invention can be understood with reference to FIG. 15. The exterior surface of jaw holder 520 has eight facets 528*a-h*, and the jaw holder surrounds and interacts with jaws 110 in a manner similar to jaw holder 120. Anvil sleeve 550 has two longitudinal openings 562*a* and 562*b* with edges 564*a* and 566*a* and 564*b* and 566*b*, respectively, that expose jaw holder facets 528*a* and 528*c*. Facets 528*a* and 528*c* are positioned such that planes extended from their surfaces would intersect in a right angle. The pulling head edge distance 568 is the edge distance of the facets 528*a* and 528*c*. Thus, pulling head 500 can be used to secure fasteners in corners where prior art pulling heads, such as the Smith head, will not fit.

In use, anvil sleeve 150, 250, 350, 450, or 550 and jaw holder 120, 220, 320, 420, or 520 are positioned to obtain the desired edge distance between the longitudinal axis of the pulling head 100, 300, 400, or 500, and the outer surface of the pulling head, as shown in FIG. 4-7, 11-12 14, or 15, respectively. A fastener, such as a lock bolt is placed through aligned openings in the workpieces to be joined, with the head of the fastener on the distal side of the workpieces and the pin extending through the aligned openings toward the pulling tool. The pulling tool is then positioned with the jaws adjacent the fastener pin. Depending on the type of pulling tool used, either the jaw holder is pulled toward the tool, or the anvil sleeve is pushed away from the tool and against the workpiece 24. Thus, the tool may apply tensile force to the jaw holder and jaws via the spindle extension 140 or via threaded ring 390 in combination with spindle extension 340. The internal frustro-conical surface at the distal end of the jaw holder urges the jaws against the pin, and the jaw holder and jaws are pulled toward the tool, and the jaw holder moves longitudinally within the anvil sleeve, which is stationary. Alternatively, the tool may apply compressive force to the anvil sleeve to push the distal end of the anvil sleeve against the fastener collar and push the collar against the proximal surface of the workpiece 24 to swage the collar onto the pin. In this case, the anvil sleeve slides longitudinally relative to the fixed jaw holder. In either case, the tool severs the portion of the pin extending proximally outward from the collar after the collar is swaged about the pin.

The pulling head of the present invention can have any desired length. The length of the side cut opening of the anvil sleeve preferably matches the length of the facets on the jaw holder and can vary to meet whatever design criteria are demanded by the application. The jaw holder can be fixed to the pulling device of the tool, as shown for example in FIGS. 2-11, or it can be made to swivel with the anvil sleeve assembly, as shown for example in FIGS. 13-14. Further, the pulling head of the present invention is adaptable for use with any pulling tool that is operative to provide sufficient compressive and tensile forces to operate the head and install fasteners.

The pulling head of the present invention is designed to withstand tensile and compressive forces which are dictated by the installation tool and the size of the fastener to be installed. These forces can be as great as 10,000 pounds per square inch, sufficient for installing most currently available aerospace and commercial fasteners.

The foregoing description is considered as illustrative only of the principles of the invention. Further, since numerous modifications and changes will readily occur to those skilled in the art, it is not desired to limit the invention to the exact construction and process shown and described above. Accordingly, all suitable modifications and equivalents may be resorted to falling within the scope of the invention.

What is claimed is:

1. A pulling head for installing fasteners, the fasteners selected from blind rivets, blind bolts, and lock bolts, said pulling head comprising:

jaws symmetrically disposed about a longitudinal axis and adapted for gripping the fasteners;

a jaw holder positioned about said jaws along said axis, said jaw holder having proximal means for joining said jaw holder to a spindle of a pulling tool and distal means for pressing said jaws against a fastener shaft, said jaw holder also having an external surface oriented lengthwise in a direction substantially parallel to said longitudinal axis and comprising at least one facet oriented lengthwise in a direction substantially parallel to said longitudinal axis, said facet spaced from said longitudinal axis by an edge distance; and an anvil sleeve positioned about said jaw holder and reciprocally slideable longitudinally relative to said jaw holder and reciprocally rotatable about said axis, said anvil sleeve including a proximal end adapted to mate with a pulling tool, a distal end adapted to swage fastener collars about fastener shafts, and a side opening extending to said distal end and sized such that the minimum distance between said axis and an exterior surface of said pulling head is substantially equal to said edge distance of said jaw holder.

2. The pulling head of claim 1, wherein:

said anvil sleeve is reciprocally rotatable about said jaw holder; and said side opening of said anvil sleeve is positionable adjacent one of said facets of said jaw holder such that the minimum edge distance of said anvil sleeve is substantially equal to the edge distance of said facet.

3. The pulling head of claim 1, wherein:

said external surface of said jaw holder has a plurality of facets; and said anvil sleeve is positionable with said side opening exposing substantially all of any one of said facets.

4. The pulling head of claim 1, wherein said external surface of said jaw holder comprises six facets forming a hexagonal cross section.

5. The pulling head of claim 1, wherein:

said facets and the side opening have substantially equal lengths in a direction parallel to said longitudinal axis of said pulling head.

6. The pulling head of claim 1, wherein:

said external surface of said jaw holder comprises four facets forming a square cross section in a direction substantially perpendicular to said axis;

the opening in said anvil sleeve is sized to expose two adjacent facets of said jaw holder; and said anvil sleeve and said jaw holder are both reciprocally rotatable about said jaws.

7. The pulling head of claim 6, wherein said anvil sleeve and said jaw holder are aligned with each other and rotatable as a unit about said jaws.

8. The pulling head of claim 1, wherein:

said external surface of said jaw holder comprises eight facets forming an octagonal cross section in a direction substantially perpendicular to said axis; and said anvil sleeve comprises two side windows positionable to expose two facets of said jaw holder, said two facets oriented at right angles relative to each other.

9. The pulling head of claim 1, wherein said pulling head is operative to apply compressive and tensile forces up to about 10,000 pounds per square inch.

10. A pulling tool for installing fasteners, the fasteners selected from blind rivets, blind bolts, and lock bolts, said tool comprising:

a pulling head, said pulling head comprising:

jaws disposed about a longitudinal axis and adapted for gripping the fasteners;

a jaw holder positioned about said jaws along said axis, said jaw holder having proximal means for joining said jaw holder to a spindle of a pulling tool, distal means for pressing said jaws about said fastener, and an external surface oriented parallel to a longitudinal axis of said pulling head and comprising at least one facet oriented lengthwise in a direction substantially parallel to said longitudinal axis, said facet spaced from said longitudinal axis by an edge distance; and an anvil sleeve positioned about said jaw holder and reciprocally slideable longitudinally relative to said jaw holder and reciprocally rotatable about said axis, said anvil sleeve including a proximal end adapted to mate with a pulling tool, a distal end adapted to swage fastener collars about fastener shafts, and a side opening having side edges and extending to said distal end and sized such that the minimum distance between said axis and an exterior surface of said pulling head is substantially equal to said edge distance of said jaw holder.

11. The tool of claim 10, wherein said means for joining said jaw holder is selected from spindles mateable with a proximal end of said jaw holder and spindle extensions mateable with a proximal end of said jaw holder.

12. The tool of claim 10, wherein said means for joining said anvil sleeve comprises a proximal end of said anvil sleeve mateable with a pushing mechanism of said tool.

13. The tool of claim 10, wherein said tool is operative to apply tensile and compressive forces up to about 10,000 pounds per square inch to a fastener.

14. The tool of claim 10, wherein said anvil sleeve is reciprocally rotatable about said jaw holder.

15. The tool of claim 10, wherein said anvil sleeve and said jaw holder are reciprocally rotatable about said jaws.

16. The tool of claim 10, wherein the side opening of said anvil sleeve is positionable to expose two of said facets of said jaw holder such that the minimum edge distance of said anvil sleeve is substantially equal to the edge distances of said facets.

17. The tool of claim 10, wherein:

said external surface of said jaw holder comprises eight facets forming an octagonal cross section in a direction substantially perpendicular to said axis;

said anvil sleeve includes two side windows positionable to expose two facets of said jaw holder, said two facets oriented at right angles relative to each other; and said anvil sleeve and said jaw holder are both reciprocally rotatable about said jaws.

18. A jaw holder for a pulling head for installing fasteners, the fasteners selected from blind rivets, blind bolts, and lock bolts, said jaw holder comprising:

a multi-faceted external surface;

a substantially cylindrical internal surface having a longitudinal axis at its radial center;

means for joining said jaw holder to a spindle of a pulling tool; and means for forcing jaws positioned inside said jaw holder into gripping engagement with a fastener shaft.

19. The jaw holder of claim 18, wherein said exterior surface includes an alignment key extending outward from said surface and mateable with an alignment keyway of an anvil sleeve positioned about said jaw holder.

20. The jaw holder of claim 19, wherein said jaw holder has strength sufficient to withstand application of tensile forces up to about 10,000 pounds per square inch in a direction parallel to said axis.

21. An anvil sleeve comprising:

a proximal end adapted to mate with a pulling tool;

a distal end adapted to swage fastener collars about fastener shafts; and a partially cylindrical tubular wall including a plurality of side openings extending to said distal end.

22. The anvil sleeve of claim 21, wherein said wall has an internal surface and said internal surface includes an alignment keyway mateable with an alignment key of a jaw holder positioned inside said anvil sleeve.

23. The anvil sleeve of claim 21, wherein said anvil sleeve has strength sufficient to withstand compressive forces up to about 10,000 pounds per square inch in a direction parallel to a longitudinal axis of said partially cylindrical wall.

* * * * *